US009581947B2

(12) United States Patent
Sakurai et al.

(10) Patent No.: US 9,581,947 B2
(45) Date of Patent: Feb. 28, 2017

(54) FIXING DEVICE AND IMAGE FORMING APPARATUS FOR TRANSMITTING HEAT TO BELT

(71) Applicant: FUJI XEROX CO., LTD., Tokyo (JP)

(72) Inventors: Yusuke Sakurai, Kanagawa (JP); Yasutaka Gotoh, Kanagawa (JP); Jota Kobayashi, Kanagawa (JP); Kyogo Soshi, Kanagawa (JP); Koji Okabe, Kanagawa (JP); Hiroko Furukata, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 15/055,953

(22) Filed: Feb. 29, 2016

(65) Prior Publication Data

US 2017/0023897 A1 Jan. 26, 2017

(30) Foreign Application Priority Data

Jul. 24, 2015 (JP) ..... 2015-146477

(51) Int. Cl.
*G03G 15/20* (2006.01)

(52) U.S. Cl.
CPC . *G03G 15/2053* (2013.01); *G03G 2215/2035* (2013.01)

(58) Field of Classification Search
CPC ..... G03G 15/2053; G03G 15/2064; G03G 2215/2035; G03G 2215/2019
USPC ..... 399/329; 219/216
See application file for complete search history.

(56) References Cited

U.S. PATENT DOCUMENTS

| | | | | |
|---|---|---|---|---|
| 8,929,790 | B2 * | 1/2015 | Suzuki | G03G 15/2053 399/122 |
| 2007/0292175 | A1 * | 12/2007 | Shinshi | G03G 15/2064 399/329 |
| 2008/0199231 | A1 * | 8/2008 | Lee | G03G 15/2039 399/329 |
| 2009/0010688 | A1 * | 1/2009 | Takahashi | G03G 15/2064 399/328 |
| 2009/0116884 | A1 * | 5/2009 | Nonaka | G03G 15/2053 399/328 |

(Continued)

FOREIGN PATENT DOCUMENTS

| | | |
|---|---|---|
| JP | 2013-205443 A | 10/2013 |
| JP | 2013-205444 A | 10/2013 |
| JP | 2014-174381 A | 9/2014 |

*Primary Examiner* — Robert Beatty
(74) *Attorney, Agent, or Firm* — Oliff PLC

(57) ABSTRACT

A fixing device includes a heater and a presser. The heater includes an endless heating belt that rotates while heating a recording medium carrying an unfixed toner image. The presser presses against the recording medium in cooperation with the heater to fix the unfixed toner image onto the recording medium. The heater further includes a first plate body extending to form a contact region in contact with an inner surface of the belt, a heat source nipping the first plate body in cooperation with the belt in the contact region, and a second plate body disposed opposite the first plate body with the heat source interposed therebetween and extending at a distance from the heat source. The first plate body has relatively higher heat absorptivity than the second plate body. The second plate body has relatively higher heat reflectivity than the first plate body and is in contact therewith.

4 Claims, 3 Drawing Sheets

(56) References Cited

U.S. PATENT DOCUMENTS

| | | | | |
|---|---|---|---|---|
| 2009/0208264 | A1* | 8/2009 | Fujiwara | G03G 15/2064 399/329 |
| 2013/0279955 | A1* | 10/2013 | Maeda | G03G 15/2053 399/329 |
| 2014/0169820 | A1* | 6/2014 | Kusumoto | G03G 15/2053 399/69 |
| 2015/0110532 | A1* | 4/2015 | Takeuchi | G03G 15/2053 399/329 |

* cited by examiner

FIXING DEVICE AND IMAGE FORMING APPARATUS FOR TRANSMITTING HEAT TO BELT

CROSS-REFERENCE TO RELATED APPLICATIONS

This application is based on and claims priority under 35 USC 119 from Japanese Patent Application No. 2015-146477 filed Jul. 24, 2015.

BACKGROUND

Technical Field

The present invention relates to fixing devices and image forming apparatuses.

SUMMARY

According to an aspect of the invention, there is provided a fixing device including a heater and a presser. The heater includes an endless heating belt that rotates while heating a transported recording medium which carries an unfixed toner image thereon. The presser presses against the recording medium by nipping the recording medium in cooperation with the heater and fixes the unfixed toner image on the recording medium onto the recording medium by operating in cooperation with the heating performed by the heater. The heater further includes a first plate body, a heat source, and a second plate body. The first plate body is disposed within the heating belt and extends to form a contact region that is in contact with an inner surface of the heating belt. The heat source nips the first plate body in cooperation with the heating belt and is in contact with the first plate body in the contact region. The second plate body is disposed opposite the first plate body with the heat source interposed therebetween and extends at a distance from the heat source. The first plate body is a member with relatively higher heat absorptivity than the second plate body. The second plate body is a member with relatively higher heat reflectivity than the first plate body and is in contact with the first plate body.

BRIEF DESCRIPTION OF THE DRAWINGS

An exemplary embodiment of the present invention will be described in detail based on the following figures, wherein.

DETAILED DESCRIPTION

An exemplary embodiment of the present invention will be described below with reference to the drawings.

Figure 1:
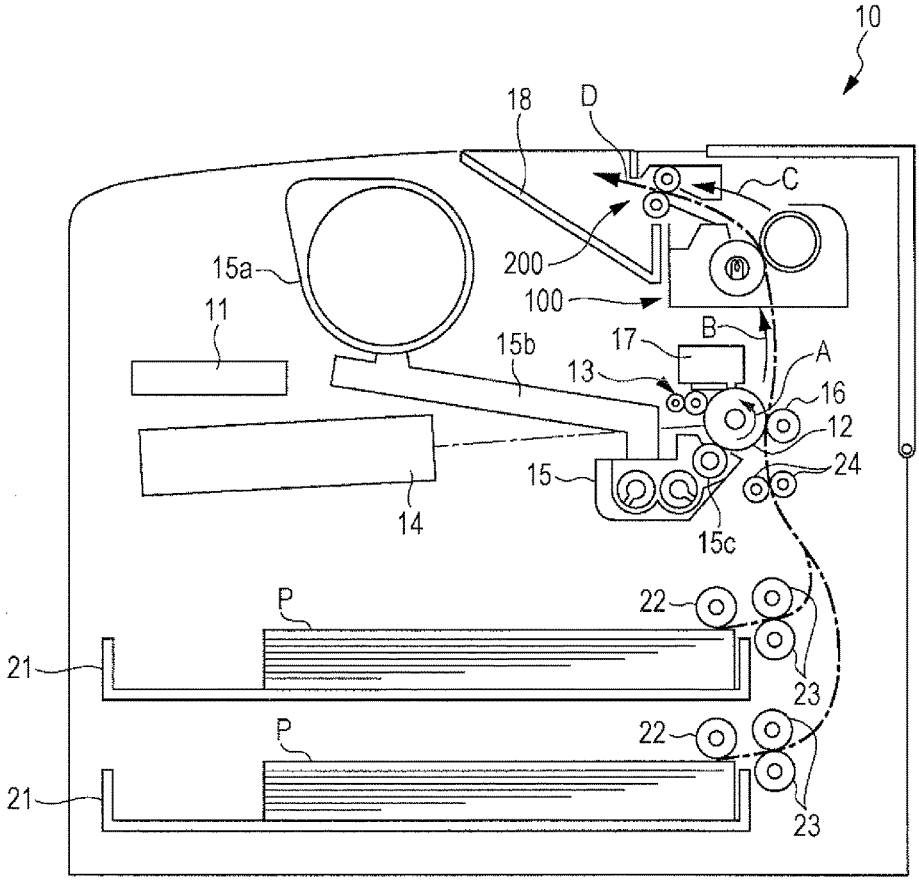
FIG. 1 schematically illustrates the configuration of a printer as an image forming apparatus according to an exemplary embodiment of the present invention.

FIG. 1 schematically illustrates the configuration of a printer as an image forming apparatus according to an exemplary embodiment of the present invention.

A printer 10 shown in FIG. 1 is a monochromatic printer. The printer 10 has a built-in fixing device according to an exemplary embodiment of the present invention.

The printer 10 receives an image signal, which is created outside the printer 10 and expresses an image, via, for example, a signal cable (not shown). The printer 10 includes a controller 11 that controls the movement of each element within the printer 10, and the image signal is input to this controller 11. Then, the printer 10 performs an image forming operation based on the image signal under the control of the controller 11.

Two sheet trays 21 are accommodated in a lower section of the printer 10. The sheet trays 21 each accommodate a stack of sheets P, which are of different sizes between the sheet trays 21. For resupplying of sheets P, the sheet trays 21 are configured to be ejectable.

Sheets P with a size that conforms to the size of the image expressed by the image signal input to the controller 11 are fed from one of the two sheet trays 21 by a pickup roller 22. The fed sheets P are separated from each other one-by-one by a separating roller 23. Each separated sheet P is transported upward so that the leading edge of the sheet P reaches a standby roller 24. The standby roller 24 has a role of adjusting a subsequent transport timing before releasing and transporting the sheet P. With regard to the sheet P that has reached the standby roller 24, the standby roller 24 further transports the sheet P while adjusting the subsequent transport timing.

In the printer 10, a photoconductor 12 that rotates in a direction indicated by an arrow A is provided above the standby roller 24. The photoconductor 12 is surrounded by a charging unit 13, an exposure unit 14, a developing unit 15, a transfer unit 16, and a photoconductor cleaner 17.

The photoconductor 12 is cylindrical and extends in the depth direction in FIG. 1. The photoconductor 12 retains electric charge in its surface by being electrostatically charged and releases the electric charge by being exposed to light, so that an electrostatic latent image is formed on the surface.

The charging unit 13 includes a charging roller that rotates while being in contact with the surface of the photoconductor 12. The charging roller applies electric charge to the surface of the photoconductor 12 so as to electrostatically charge the surface. As an alternative to a charging roller, for example, a corona discharger that does not come into contact with the photoconductor 12 may be used as the charging unit 13.

The exposure unit 14 has a light emitter that emits laser light (exposure light) modulated in accordance with the image signal supplied from the controller 11 and a rotating polygonal mirror for scanning the photoconductor 12 with the laser light. The exposure light is output from the exposure unit 14. The photoconductor 12 is exposed to this exposure light so that an electrostatic latent image is formed on the surface of the photoconductor 12. As an alternative to a type that uses laser light, for example, a light-emitting-diode (LED) array having multiple LEDs arranged in the scanning direction may be used as the exposure unit 14. Furthermore, for example, a method of directly forming a latent image by using multiple electrodes arranged in the scanning direction may be used as the latent-image forming method in place of the exposure method.

The electrostatic latent image formed on the surface of the photoconductor 12 as a result of the surface being exposed to the exposure light undergoes a developing process performed by the developing unit 15. The developing unit 15 is connected to a toner container 15*a* via a toner supply path 15*b*. The developing unit 15 stores therein a developer that contains a toner and a magnetic carrier, and a toner stored in the toner container 15*a* is appropriately supplied to the developing unit 15 via the toner supply path 15*b*. The magnetic carrier is, for example, iron powder whose surface is coated with resin. The toner particles are composed of binding resin, a coloring agent, and a release agent. The developing unit 15 stirs the developer containing a mixture of magnetic carrier particles and toner particles so as to electrostatically charge the toner and the magnetic carrier. The developing unit 15 includes a developing roller 15*c*. The developer within the developing unit 15 is supplied to the photoconductor 12 by the developing roller 15*c* so that the latent image on the surface of the photoconductor 12 is developed using the electrostatically-charged toner in the developer, whereby a toner image is formed.

The standby roller 24 described above releases and transports the sheet P such that the sheet P reaches a position facing the transfer unit 16 in accordance with the timing at which the toner image on the photoconductor 12 reaches that position. Then, the toner image on the photoconductor 12 is transferred onto the transported sheet P due to the function of the transfer unit 16. The transfer unit 16 used may be of a type that is equipped with an intermediate transfer body and that temporarily transfers the toner image on the photoconductor 12 onto the intermediate transfer body and subsequently transfers the toner image on the intermediate transfer body onto a sheet P.

After the toner-image transfer process, the toner remaining on the photoconductor 12 is removed from the photoconductor 12 by the photoconductor cleaner 17.

The combination of the photoconductor 12, the charging unit 13, the exposure unit 14, the developing unit 15, and the transfer unit 16 corresponds to an example of an image forming device according to an exemplary embodiment of the present invention.

The sheet P having the toner image transferred thereon further travels in a direction indicated by an arrow B and is heated and pressed by a fixing unit 100, so that the toner image becomes fixed onto the sheet P. As a result, an image constituted of a fixed toner image is formed on the sheet P. This fixing unit 100 corresponds to a fixing device according to an exemplary embodiment of the present invention.

The sheet P that has passed through the fixing unit 100 travels toward an output unit 200 in a direction indicated by an arrow C. Then, the sheet P is transported further in a direction indicated by an arrow D by the output unit 200 so as to be output onto an output tray 18.

A mechanism in this printer 10 that fetches a sheet P from one of the sheet trays 21, transports the sheet P through the area between the photoconductor 12 and the transfer unit 16, further transports the sheet P through the fixing unit 100, and then outputs the sheet P onto the output tray 18 corresponds to an example of a transport device according to an exemplary embodiment of the present invention.

Figure 2:
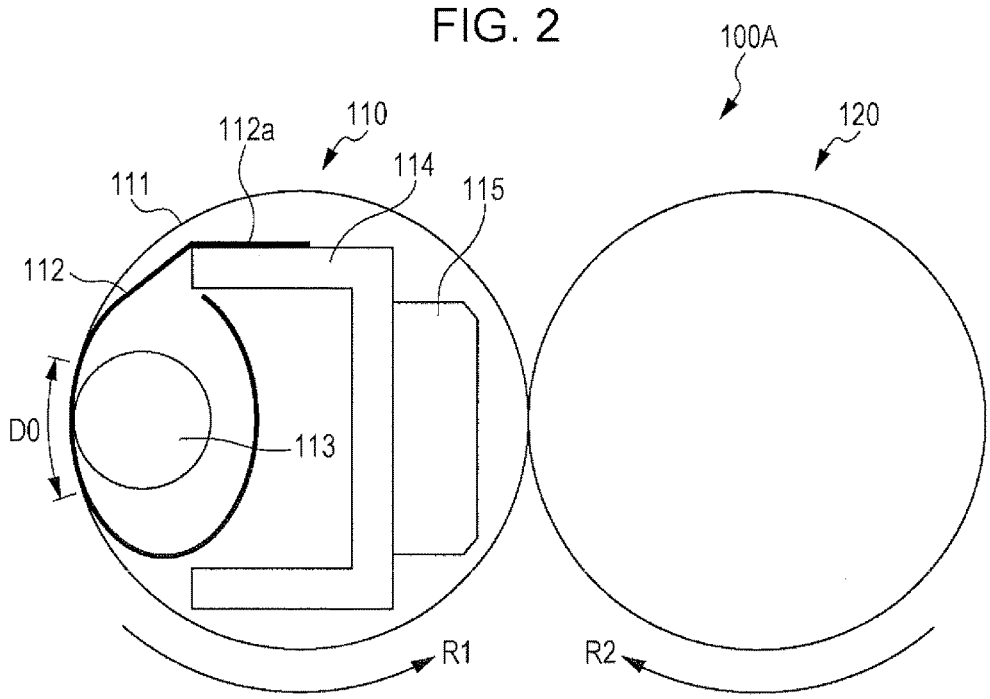
FIG. 2 illustrates the cross-sectional structure of a first example of a fixing unit.

FIG. 2 illustrates the cross-sectional structure of a first example of a fixing unit. A fixing unit 100A shown in FIG. 2 is a first example of a fixing unit that may be used as the fixing unit 100 provided in the printer 10 shown in FIG. 1.

The fixing unit 100A includes a heater 110 and a presser 120.

The heater 110 includes an endless heating belt 111. The heater 110 is equipped with a heat conduction member 112, a halogen lamp 113, a support member 114, and a nip member 115 within the heating belt 111.

The support member 114 extends in a direction orthogonal to the plane of the drawing in FIG. 2. The opposite ends of the support member 114, which protrude outward from the opposite edges of the heating belt 111, are supported by a housing of the printer 10 (FIG. 1). The support member 114 serves a base for supporting the other members provided within the heating belt 111.

The nip member 115 is supported by the support member 114 and receives pressure from the presser 120.

The presser 120 according to this exemplary embodiment is roller-shaped and is rotated in a direction indicated by an arrow R2 by a driver (not shown). Although the heating belt 111 is illustrated as being circular in FIG. 2, the heating belt 111 is pressed against the nip member 115 by the presser 120 so as to be deformed in a shape that conforms to the surface shape of the nip member 115. The heating belt 111 deforms by being nipped between the nip member 115 and the presser 120, thereby forming a nip region where a transported sheet is nipped between the heating belt 111 and the presser 120. Furthermore, the heating belt 111 is rotationally driven in a direction indicated by an arrow R1 by the rotation of the presser 120 in the direction of the arrow R2.

The heat conduction member 112 disposed within the heating belt 111 is formed of a plate member composed of a material with high heat conductivity, such as metal. One end 112*a* of the heat conduction member 112 in the rotational direction of the heating belt 111 is fixed to the support member 114. The heat conduction member 112 extends along the heating belt 111 and is in contact with the inner surface of the heating belt 111. A region of the heating belt 111 that is in contact with the heat conduction member 112 will be referred to as "contact region D0". The heat conduction member 112 forms the contact region D0 and extends further to embrace the halogen lamp 113. The heat conduction member 112 extends in the direction orthogonal to the plane of the drawing in FIG. 2 while maintaining the cross-sectional shape shown in FIG. 2.

The halogen lamp 113 is disposed at a position where the halogen lamp 113 and the heating belt 111 nip the heat conduction member 112 therebetween in the contact region D0. The halogen lamp 113 is secured to the heat conduction member 112 so as to be in contact with the heat conduction member 112.

Figure 3:
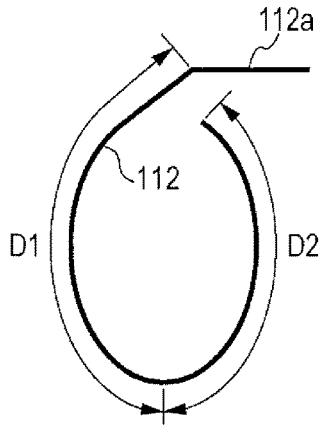
FIG. 3 is a cross-sectional view of a heat conduction member alone.

FIG. 3 is a cross-sectional view of the heat conduction member 112 alone.

As described above, the heat conduction member 112 is composed of, for example, a metallic material and thus has high heat conductivity. Moreover, the inner surface of the heat conduction member 112 that faces the halogen lamp 113 is mirror-finished so that the heat reflectivity of the inner surface is increased. The inner surface of the heat conduction member 112 also has a heat absorption region D1 that occupies substantially half of the area facing the halogen lamp 113. The heat absorption region D1 is given a black coating so that the heat absorptivity thereof is increased. In the heat conduction member 112, the remaining region of the inner surface excluding the black-coated heat absorption region D1, that is, the mirror-finished region with high heat reflectivity, which is opposite the heat absorption region D1 with the halogen lamp 113 interposed therebetween and extends at a distance from the halogen lamp 113, will be referred to as "heat reflection region D2".

Specifically, in the heat conduction member 112, the heat absorption region D1 has relatively higher heat absorptivity than the heat reflection region D2, whereas the heat reflection region D2 has relatively higher heat reflectivity than the heat absorption region D1. The heat conduction member 112 is formed of a single plate member. Therefore, the heat reflection region D2 is continuously connected to the heat absorption region D1. In this exemplary embodiment, the heat absorption region D1 and the heat reflection region D2 of the heat conduction member 112 respectively correspond to examples of a first plate body and a second plate body according to an exemplary embodiment of the present invention.

The halogen lamp 113 is in contact with the heat absorption region D1 of the heat conduction member 112. Therefore, the heat of the halogen lamp 113 is first directly absorbed by the heat absorption region D1 of the heat conduction member 112 from the halogen lamp 113 and is then transmitted to the heating belt 111. The radiant heat radiating toward the heat reflection region D2 from the halogen lamp 113 is reflected at the heat reflection region D2 toward the heat absorption region D1 and is absorbed by the heat absorption region D1, thus heating the heating belt 111. In the first example, the heat absorption region D1 and the heat reflection region D2 are both formed in the heat conduction member 112 formed of a single plate member so as to be continuously connected to each other. Therefore, heat absorbed by the heat reflection region D2 without being reflected at the heat reflection region D2 travels through the heat conduction member 112 due to heat conduction so as to be conducted to the heat absorption region D1, and is consequently transmitted to the heating belt 111.

In this exemplary embodiment, the halogen lamp 113 is directly in contact with the heat conduction member 112 so that the heat is directly transmitted to the heating belt 111 via the heat conduction member 112 formed of a single plate member. Therefore, the heat of the halogen lamp 113 may be efficiently transmitted to the heating belt 111, as compared with a structure in which the halogen lamp 113 is distant from the heat conduction member 112.

Furthermore, in this exemplary embodiment, the heat absorption region D1 and the heat reflection region D2 are formed in the heat conduction member 112, and the radial heat from the halogen lamp 113 is efficiently concentrated in the contact region having a function of transmitting heat to the heating belt 111.

Moreover, in this exemplary embodiment, the heat conduction member 112 is formed of a single plate member, and the heat absorption region D1 and the heat reflection region D2 are formed in the single plate member. Therefore, the heat absorbed by the heat reflection region D2 is also transmitted to the heat absorption region D1 due to heat transmission through the heat conduction member 112.

Accordingly, in the first example, the heat of the halogen lamp 113 may be efficiently transmitted to the heating belt 111.

Figure 4:
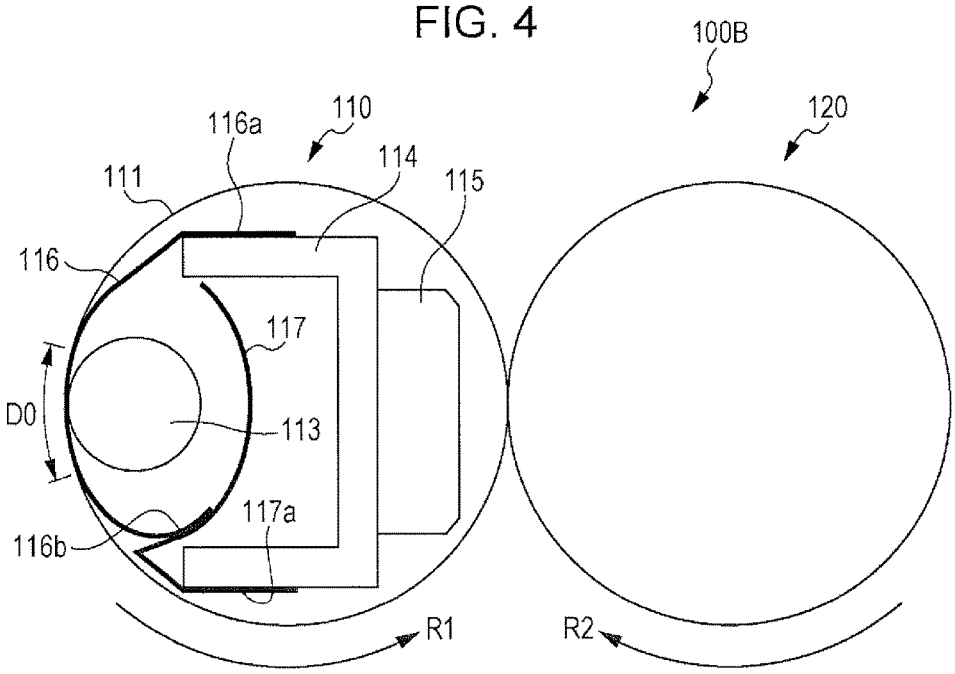
FIG. 4 illustrates the cross-sectional structure of a second example of a fixing unit.

FIG. 4 illustrates the cross-sectional structure of a second example of a fixing unit. A fixing unit 100B shown in FIG. 4 may be used in place of the fixing unit 100A shown in FIG. 2 in the printer 10 shown in FIG. 1.

In FIG. 4, elements that are the same as the elements of the fixing unit 100A shown in FIG. 2 are given the same reference characters as those given in FIG. 2. With regard to the fixing unit 100B shown in FIG. 4, features different from those of the fixing unit 100A shown in FIG. 2 will be described.

In the fixing unit 100A shown in FIG. 2, a single heat conduction member 112 is provided, and the heat absorption region D1 and the heat reflection region D2 are both formed in the heat conduction member 112. In contrast, in the fixing unit 100B shown in FIG. 4, a heat absorption member 116 and a heat reflection member 117 are provided in place of the heat conduction member 112 in the fixing unit 100A in FIG. 2.

The heat absorption member 116 is formed of a plate member composed of a material with high heat conductivity, such as metal, and is given a black coating for increasing the heat absorptivity of radial heat. An upper end 116*a*, shown in FIG. 4, of the heat absorption member 116 in the rotational direction of the heating belt 111 is fixed to the support member 114. The heat absorption member 116 extends along the heating belt 111, is in contact with the inner surface of the heating belt 111 to form the contact region D0, and further extends downward. The heat absorption member 116 extends in the direction orthogonal to the plane of the drawing in FIG. 4 while maintaining the cross-sectional shape shown in FIG. 4.

The halogen lamp 113 is disposed at a position where the halogen lamp 113 and the heating belt 111 nip the heat absorption member 116 therebetween in the contact region D0. The halogen lamp 113 is secured to the heat absorption member 116 so as to be in contact with the heat absorption member 116.

With regard to the heat reflection member 117, the base material thereof is formed of a plate member composed of a material with high heat conductivity, such as metal, which is the same as that of the heat absorption member 116. However, the heat reflection member 117 is not given a coating but is given a mirror-finished surface for increasing the reflectivity of radial heat. A lower end 117*a* of the heat reflection member 117 shown in FIG. 4 is fixed to the support member 114 and extends upward so as to be in contact with the heat absorption member 116. The heat reflection member 117 lifts a lower end 116*b* of the heat absorption member 116 upward so as to cause the heat absorption member 116 to elastically deform. Thus, the heat absorption member 116 and the heat reflection member 117 are always in contact with each other even when there is, for example, vibration to some extent. Moreover, the heat reflection member 117 extends at a distance from the halogen lamp 113, with the halogen lamp 113 disposed between the heat reflection member 117 and the heat absorption member 116.

Since the functions of the heat absorption member 116 and the heat reflection member 117 are respectively similar to the functions of the heat absorption region D1 and the heat reflection region D2 of the heat conduction member 112 incorporated in the fixing unit 100A in FIG. 2, redundant descriptions will be omitted here. Because the heat reflection member 117 is in contact with the heat absorption member 116, the transmission of heat absorbed by the heat reflection member 117 toward the heat absorption member 116 is the same as that in the heat conduction member 112 in FIG. 2.

Accordingly, the first plate body and the second plate body according to an exemplary embodiment of the present invention do not have to be a single continuous member and may alternatively be separate members.

Figure 5:
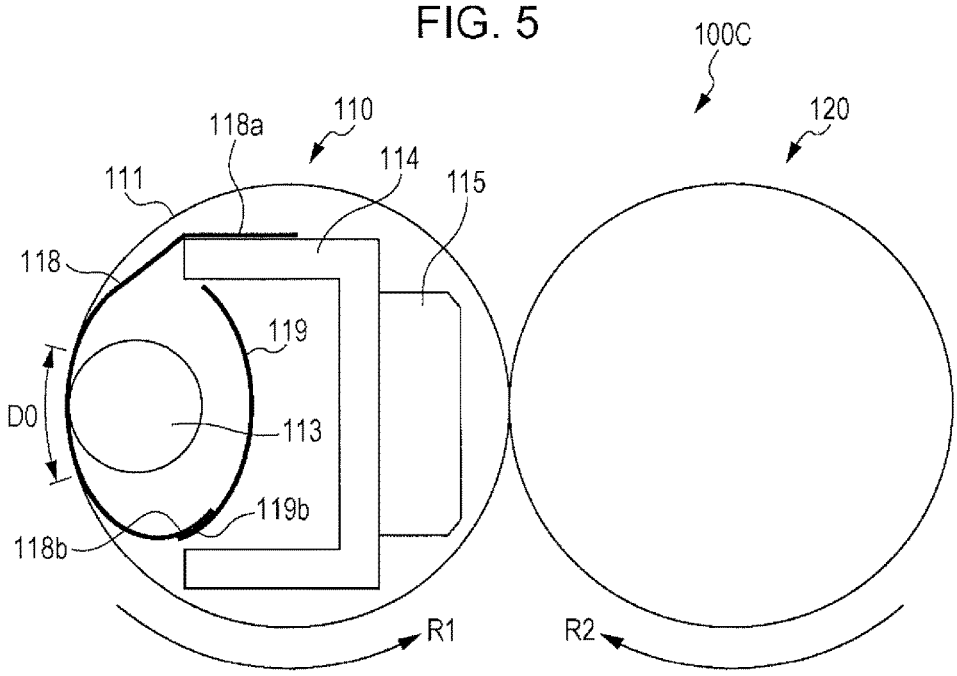
FIG. 5 illustrates the cross-sectional structure of a third example of a fixing unit.

FIG. 5 illustrates the cross-sectional structure of a third example of a fixing unit. A fixing unit 1000 shown in FIG. 5 may be used in place of the fixing unit 100A shown in FIG. 2 in the printer 10 shown in FIG. 1.

In the fixing unit 1000 shown in FIG. 5, elements that are the same as the elements of the fixing unit 100B shown in FIG. 4 are given the same reference characters as those given in FIG. 4. With regard to the fixing unit 1000 shown in FIG. 5, features different from those of the fixing unit 100B shown in FIG. 4 will be described.

The fixing unit 1000 shown in FIG. 5 is provided with a heat absorption member 118 and a heat reflection member 119 in place of the heat absorption member 116 and the heat reflection member 117 provided in the fixing unit 1003 shown in FIG. 4. Although different in shapes, the heat absorption member 118 and the heat reflection member 119 shown in FIG. 5 are similar in, for example, materials and surface properties to those of the heat absorption member 116 and the heat reflection member 117 shown in FIG. 4.

The fixing unit 1000 shown in FIG. 5 is different from the fixing unit 100B shown in FIG. 4 in that a lower end 119*b* of the heat reflection member 119 is fixed to a lower end 118*b* of the heat absorption member 118 so that the heat reflection member 119 is supported only by the heat absorption member 118.

The heat reflection member 117 of the fixing unit 100B shown in FIG. 4 is in contact with the heat absorption member 116, but the lower end 117*a* is fixed to the support member 114. Therefore, a portion of the heat absorbed by the heat reflection member 117 is transmitted and dissipated to the support member 114 without being transmitted to the heat absorption member 116.

In contrast, since the heat reflection member 119 of the fixing unit 1000 shown in FIG. 5 is supported only by the heat absorption member 118, the heat transmission rate of heat absorbed by the heat reflection member 119 toward the heat absorption member 118 is increased. Thus, the efficiency of heat transmission to the heating belt 111 may further be enhanced in the fixing unit 1000 shown in FIG. 5, as compared with the fixing unit 1003 shown in FIG. 4.

Although the heat absorption region D1 and the heat absorption members 116 and 118 of the heat conduction member 112 are each described as being given a black coating, heat absorptivity may be increased based on an alternative surface treatment other than a black coating, or the material itself may have high heat absorptivity. However, if a material with high heat absorptivity is used in the case of the heat conduction member 112 integrally having the heat reflection region D2, the heat reflection region D2 has to be given a treatment for increasing heat reflectivity.

Although the contact region D0 is formed at a position different from that of the nip member 115 by 180° in the rotational direction of the heating belt 111, the contact region D0 is not limited to this position and may be formed at any position in the rotational direction.

Although a monochromatic printer is described as an example of an image forming apparatus in the above exemplary embodiment, the image forming apparatus according to an exemplary embodiment of the present invention may be a color printer, or may be, for example, a facsimile apparatus, a copier, or a multifunction apparatus.

In the above exemplary embodiment, an image forming device of a type that transfers a toner image formed on a photoconductor onto a recording medium is described as an example of an image forming device according to an exemplary embodiment of the present invention. Alternatively, the image forming device according to an exemplary embodiment of the present invention may be of a type that directly forms a toner image onto a recording medium.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The embodiment was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A fixing device comprising:

a heater including an endless heating belt that rotates while heating a transported recording medium, which carries an unfixed toner image thereon; and a presser that presses against the recording medium by nipping the recording medium in cooperation with the heater and that fixes the unfixed toner image on the recording medium onto the recording medium by operating in cooperation with the heating performed by the heater, wherein the heater further includes a first plate body disposed within the heating belt and extending to form a contact region that is in contact with an inner surface of the heating belt, a heat source that nips the first plate body in cooperation with the heating belt and is in contact with the first plate body in the contact region, and a second plate body that is disposed opposite the first plate body with the heat source interposed therebetween and that extends at a distance from the heat source, wherein the first plate body is a member with relatively higher heat absorptivity than the second plate body, wherein the second plate body is a member with relatively higher heat reflectivity than the first plate body and is in contact with the first plate body, and wherein an end of the second plate body is unsupported.

2. A fixing device comprising:

a heater including an endless heating belt that rotates while heating a transported recording medium, which carries an unfixed toner image thereon; and a presser that presses against the recording medium by nipping the recording medium in cooperation with the heater and that fixes the unfixed toner image on the recording medium onto the recording medium by operating in cooperation with the heating performed by the heater, wherein the heater further includes a first plate body disposed within the heating belt and extending to form a contact region that is in contact with an inner surface of the heating belt, a heat source that nips the first plate body in cooperation with the heating belt and is in contact with the first plate body in the contact region, and a second plate body that is disposed opposite the first plate body with the heat source interposed therebetween and that extends at a distance from the heat source, wherein the first plate body is a member with relatively higher heat absorptivity than the second plate body, wherein the second plate body is a member with relatively higher heat reflectivity than the first plate body and is in contact with the first plate body, and wherein the second plate body is supported only by the first plate body.

3. A fixing device comprising:

a heater including an endless heating belt that rotates while heating a transported recording medium, which carries an unfixed toner image thereon; and a presser that presses against the recording medium by nipping the recording medium in cooperation with the heater and that fixes the unfixed toner image on the recording medium onto the recording medium by operating in cooperation with the heating performed by the heater, wherein the heater further includes a first plate body disposed within the heating belt and extending to form a contact region that is in contact with an inner surface of the heating belt, a heat source that nips the first plate body in cooperation with the heating belt and is in contact with the first plate body in the contact region, and a second plate body that is disposed opposite the first plate body with the heat source interposed therebetween and that extends at a distance from the heat source, wherein the first plate body is a member with relatively higher heat absorptivity than the second plate body, wherein the second plate body is a member with relatively higher heat reflectivity than the first plate body and is in contact with the first plate body, and wherein the first plate body and the second plate body are formed of a single member and are given different heat absorptivity and different heat reflectivity by surface treatments.

4. An image forming apparatus comprising:

the fixing device according to claim 1;

an image forming device that forms an unfixed toner image onto a recording medium; and a transport device that transports the recording medium along a path extending through the image forming device and the fixing device.

* * * * *